US010603691B2

(12) United States Patent
Mack

(10) Patent No.: US 10,603,691 B2
(45) Date of Patent: Mar. 31, 2020

(54) MEDIA SIFTER FOR BULLET CASINGS

(71) Applicant: Hornady Manufacturing Company, Grand Island, NE (US)

(72) Inventor: Matthew Mack, Grand Island, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 25 days.

(21) Appl. No.: 16/180,610

(22) Filed: Nov. 5, 2018

(65) Prior Publication Data

US 2019/0134669 A1 May 9, 2019

Related U.S. Application Data

(60) Provisional application No. 62/582,352, filed on Nov. 7, 2017.

(51) Int. Cl.

| | |
|---|---|
| ***B07B 1/22*** | (2006.01) |
| ***B07B 1/42*** | (2006.01) |
| ***F42B 33/14*** | (2006.01) |

(52) U.S. Cl.

CPC ..... *B07B 1/22* (2013.01); *B07B 1/42* (2013.01); *F42B 33/14* (2013.01)

(58) Field of Classification Search

CPC ..... F42B 33/14; B07B 1/22; B07B 1/42

USPC ..... 209/235, 283, 288

See application file for complete search history.

(56) References Cited

U.S. PATENT DOCUMENTS

| | | | | |
|---|---|---|---|---|
| 48,520 | A * | 7/1865 | Colby | B07B 1/20 209/283 |
| 1,429,565 | A * | 9/1922 | Johnson | B07B 1/22 209/284 |
| 1,491,601 | A * | 4/1924 | Fuller | B24B 31/0218 451/329 |
| 1,862,412 | A * | 6/1932 | MacLellan | B01F 7/1695 209/283 |
| 5,036,623 | A | 8/1991 | Alonzo et al. | |
| 5,137,366 | A * | 8/1992 | Hill | B28C 5/4272 192/69.82 |
| 6,733,375 | B2 | 5/2004 | Hoffman | |
| 10,000,148 | B1 * | 6/2018 | Haynes | B60P 7/0846 |
| 2008/0023379 | A1 * | 1/2008 | Potterfield | F42B 33/10 209/689 |
| 2016/0101443 | A1 | 4/2016 | Christensen et al. | |

* cited by examiner

*Primary Examiner* — Terrell H Matthews
(74) *Attorney, Agent, or Firm* — McHale & Slavin, P.A.

(57) ABSTRACT

A media sifter is provided that is operable to separate cleaning media from casings. The sifter has components configured to selectively prevent rotation and allow rotation of a sifting drum rotatably mounted in a housing. The housing has both a cover and a media collection base.

11 Claims, 5 Drawing Sheets

MEDIA SIFTER FOR BULLET CASINGS

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/582,352, entitled "MEDIA SIFTER FOR BULLET CASINGS", filed Nov. 7, 2017. The contents of the above referenced application are incorporated herein by reference in its entirety.

FIELD OF THE INVENTION

A media sifter is provided that is constructed to separate cartridge casings from particulate media used to clean and/or polish casings, particularly for reloading.

BACKGROUND OF THE INVENTION

By way of background, a centerfire cartridge includes a case or casing that holds the powder (or propellant). A primer is inserted in a primer pocket of the casing, and a bullet (the projectile) is inserted into a neck of the casing. A casing can be handloaded by an individual to make a cartridge, and a used casing can be reloaded to make a cartridge. Often, a cartridge is inaccurately referred to as a bullet.

Casings, new or used, are typically cleaned and polished in a device such as a vibratory tumbler containing cleaning media. The cleaning media needs to be separated from the casings after the cleaning process. Such separation is typically accomplished with a media sifter, which is well known in the art of reloading ammunition. Such sifters can be as simple as a pan with holes in the bottom into which the casings and cleaning media are poured after cleaning/polishing. The holes allow the media to flow out of the pan into a bucket or the like. However, with this type of simple sifter, the casings will generally have media left in them, requiring that each casing be handled to turn the neck down to allow any contained media to flow out. One such pan is frustoconical, allowing a very large surface area for pouring the casings and media into and a smaller bottom to direct the outflow of the separated media. Another popular type of media sifter is a rotating drum. The drum is mounted to a housing having a separated media collection bottom portion. The housing may also have a removable lid for mounting on the bottom. The housing holds a removable drum that is separable into two halves. One half of the drum is removed or moved relative to the other half, exposing an open top on the other half into which the media and casings are poured. Both drum halves contain numerous holes through which separated media flows into the housing bottom. After the media and casings are poured into a bottom drum half, the top drum half is positioned over the bottom half and held in place. A crank arm is provided to allow the user to rotate the drum about a center axis to help effect separation of the media from the casings.

DESCRIPTION OF THE PRIOR ART

There are numerous manufacturers of both types of the above described media sifters. Those manufacturers include Hornady, RCBS, Berry's, Lyman, Dillon, Franklin Arsenal and others. Such sifters are typically made out of lightweight plastic and weigh less than the casings and media poured therein for separation. In the case of rotary drum type sifters, the drums are subject to being put in and out of a balanced condition when pouring the media and casings. This can cause the drum to rotate and dump out the contained media and casings, requiring starting over. Likewise, some of the drums in such sifters have the top half hingedly connected to the bottom half of the drum, also causing an out of balance condition. Although, the housing on which the drum is rotatably mounted can limit movement of the top drum half hingedly connected to the bottom drum half. Further, such drum sifters will require an extra mold for forming each of the two halves of the drum since the two drum halves have differing constructions. This increases the cost of tooling and hence production of the drum halves.

There is thus a need for an improved media sifter.

SUMMARY OF THE INVENTION

It is an objective of the present invention to provide an improved media sifter for use in separating clean and/or polished casings from the cleaning media.

It is another objective of the present invention to provide a media sifter that has components configured to selectively prevent rotation of the separating drum.

It is a further objective of the present invention to provide such a media sifter with substantially identical drum halves.

It is yet another objective of the present invention to provide a media sifter with the drum having two halves that are separable for tilling one drum half and joinable for rotating the drum to effect separation of casings and media.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION THE INVENTION

Figure 1:
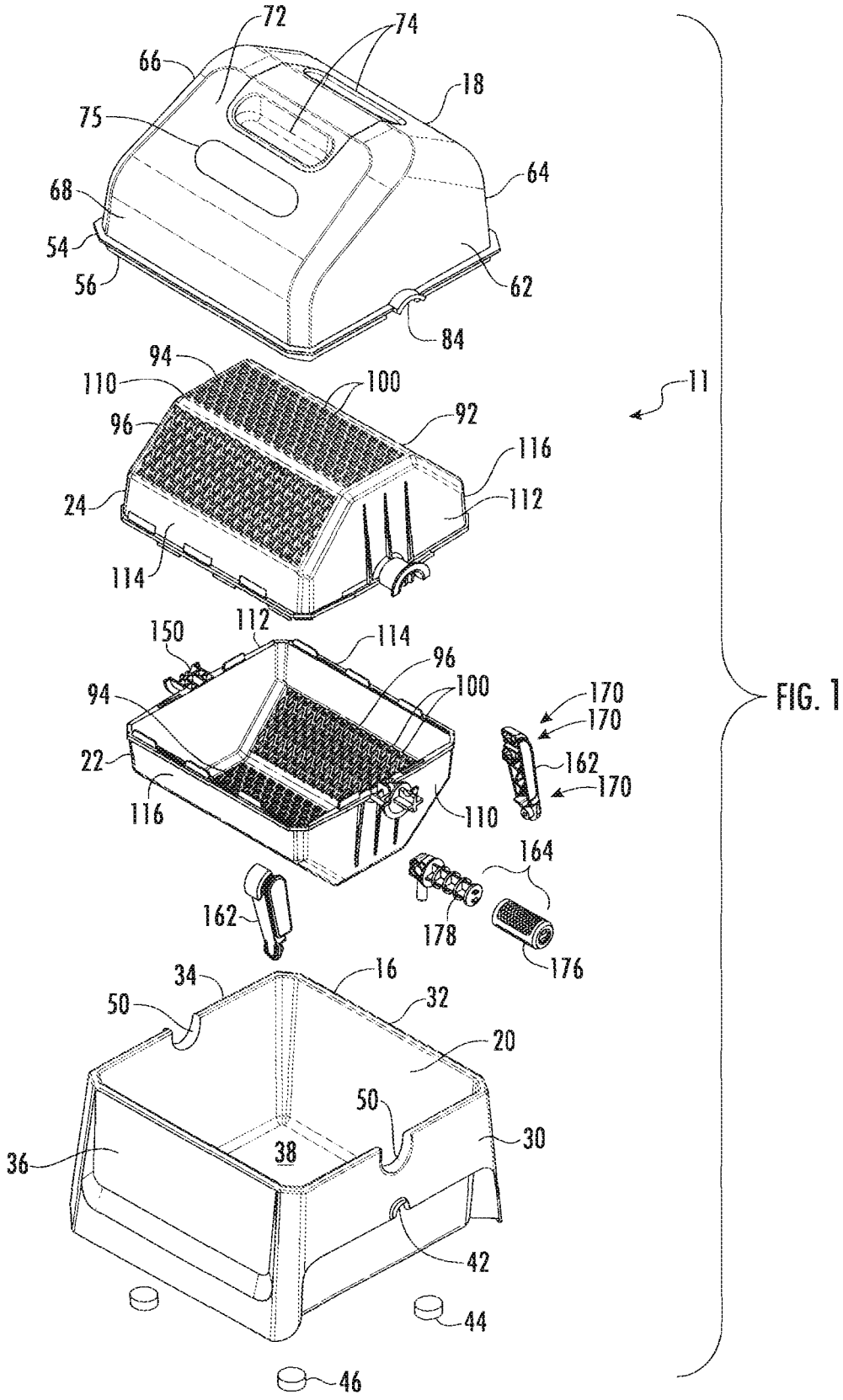
FIG. 1 is an exploded perspective view of a media sifter.

A media sifter, designated generally 11, is operable for separating, cleaning and/or polishing media, herein media, from casings used to form loaded cartridges, such as rifle and pistol ammunition. The sifter 11 includes a housing 12 and a perforate drum 14 that is rotatably mounted in the housing 12. The housing 12 includes a base storage unit 16 and a cover 18. The base 16 and cover 18 are separable to provide access to the interior chamber 20 of the base 16. The drum 14 is rotatably mounted in the housing 12 and, as best seen in FIG. 1, the drum 14 includes separable drum halves 22, 24. While "half" is used herein, that does not necessarily mean that the size and/or shape are the same for each component, or that there is symmetry, but rather that there are two components to the whole as described herein.

The housing 12 comprises both the base 16 and the cover 18. The base 16 has an interior chamber 20 for receipt of a portion of the drum 14 therein. The base 16 is comprised of a plurality of side walls 30, 32, 34, 36 and a bottom wall 38. The sidewalls 30, 32, 34, 36 and the bottom wall 38 are interconnected and define an open top chamber 20. At least the sidewalls 30, 34 have a boss 40 in the form of a skirt with a notch 42 therein, with the notch preferably opening downwardly. As shown, the notch 42 is generally semicircular. The base 16 can be provided with attached friction pads 44 to help hold the sifter 11 in place during use. The friction pads 44 are secured to the bottom wall 38, and will engage an underlying surface such as a tabletop or benchtop. The opposite sidewalls 30, 34, are each provided with a generally semicircular recess 50 forming a bearing race.

Figure 3:
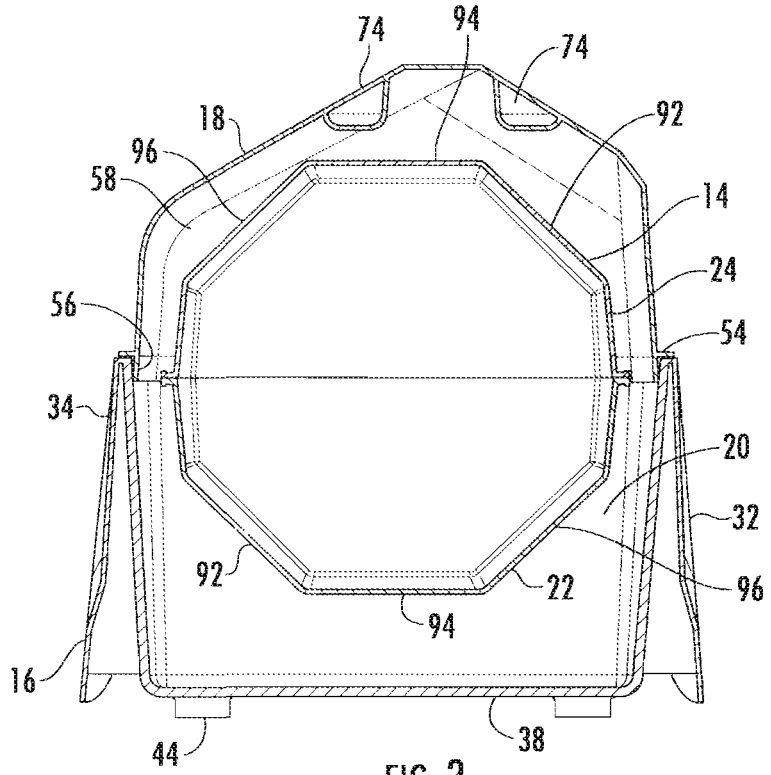
FIG. 3 is a sectional view of the sifter taken along the line A-A of FIG. 2.

The cover 18 is adapted to rest on the top of the base 16. As shown, the cover 18 has a peripherally extending flange 54 extending outwardly from a lower portion of the cover 18, and is adapted to rest on the top surface of the base 16 to keep the cover 18 aligned with the open top of the base 16. A depending flange 56 fits within the open top of the base 16, while the flange 54 prevents movement of the cover 18 by fitting down into the base 16. The cover 18 includes an interior chamber 58 for receiving an upper portion of the drum 14 therein, particularly during operation of the sifter 11. This can be best seen in FIG. 3. As seen in FIG. 1, the cover 18 has four connected sidewalls 62, 64, 66, and 68. In a preferred embodiment, the cover 18 is provided with a top 72 having recesses 74 therein to provide a handhold for an operator during use of the sifter 11, and provide a place for the operator to grip the cover 18 to move it onto or off of the base 16. Like the base 16, the opposite sidewalls 62, 66 of the cover 18 are provided with recesses 84 that are each in alignment with a respective recess 50. Preferably, the recesses 84 have a generally semicircular shape and form a bearing race. The base 16, drum halves 22, 24 and cover 18 are preferably molded of a polymeric material.

The cover 18 can be made of a transparent material, such as polycarbonate, to allow a user of the sifter 11 to view and monitor the sifting operation. Alternately, the cover 18 can be provided with a transparent window 75 for the same purpose.

The drum 14, in a preferred embodiment, has the two halves 22, 24 that are similar in shape and can be substantially identical in shape and construction. By being substantially identical in shape, only one tool need be provided to effect the formation of the two halves 22, 24 as by molding with a polymeric material. (The use of the term substantially identical herein does not mean that with precision measuring the parts are identical. Given that the halves 22, 24 are preferably molded, there will be differences, even though they might be made in the same mold. There will be inherent differences from shrinkage and stresses that will be relieved over time, but the halves 22, 24 will preferably have generally the same components in the same locations.) The drum 14 has at least a portion thereof perforated for flow of media out of the drum 14. In the illustrated structure, the drum halves 22, 24 each have a plurality of perforate panels 92, 94, 96. As shown, the panels 92, 94, 96 are generally planar and generally rectangular. The perforations 100 in the panels 92, 94, 96 are sufficiently large to allow the cleaning and/or polishing media to pass therethrough, yet small enough to prevent cartridge casings from passing therethrough. Each of the drum halves 22, 24 have end panels 110, 112 joining it to the panels 92, 94, 96 and two side panels 114, 116. Preferably, the drum halves 22, 24 are of an integral molded structure. The side panels 114, 116 are also generally planar and are generally rectangular. The combination of the panels 92, 94, 96, 114, 116 form a generally octagonal structure when the drum halves 22, 24 are joined together. However, it is to be understood that other shapes for the drum 14 can be provided. When the drum 14 is mounted to the base 16, there is enough volume under the drum 14 in the chamber 20 above the bottom wall 38 to hold the separated media.

Figure 6:
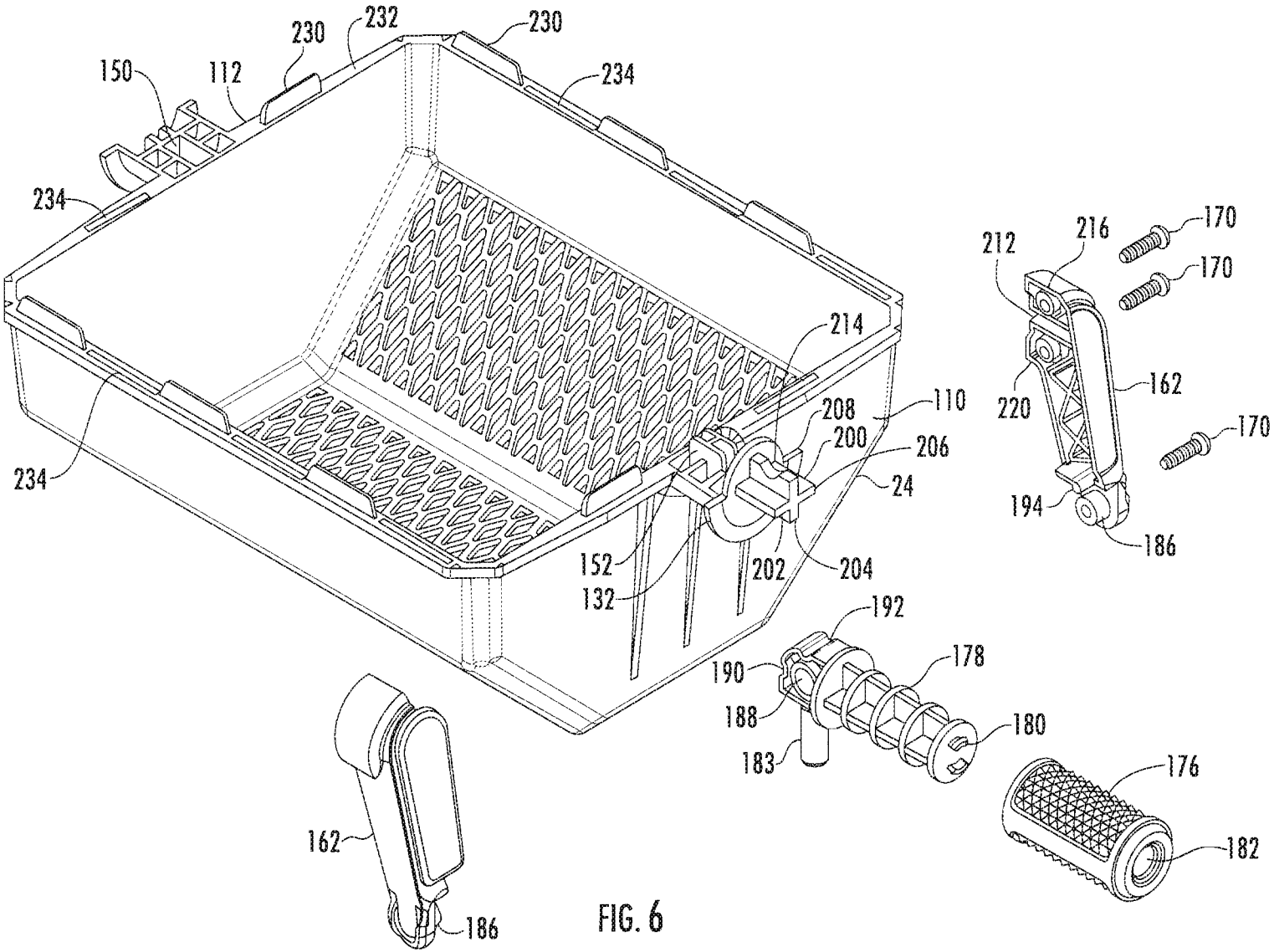
FIG. 6 is an exploded perspective view of one drum half and the crank.
Figure 7:
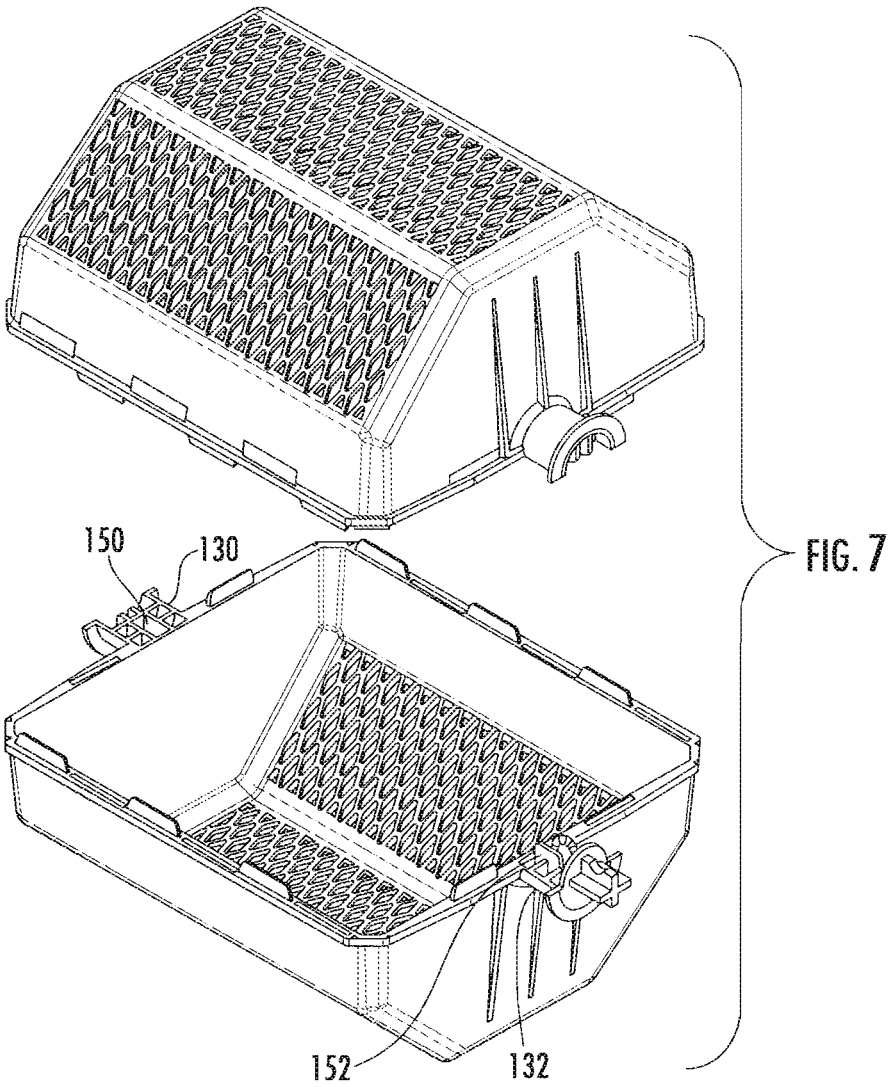
FIG. 7 is an exploded perspective view of the top and bottom drum halves.
Figure 8:
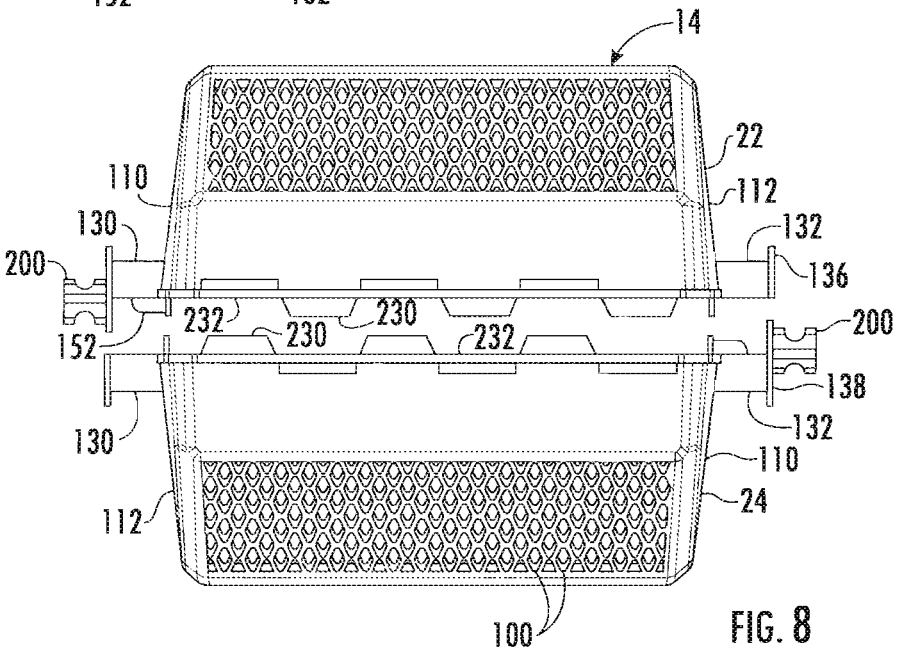
FIG. 8 a front elevation view of the top and bottom drum halves shown separated.

As best seen in FIGS. 6-8, the drum halves 22, 24 are provided with means for rotatably mounting the drum 14 to the base 16. In the illustrated embodiment, the drum halves 22, 24 are substantially identical in construction and will be described as such. However, it is to be noted that the drum halves 22, 24 can have different constructions. The construction of drum half 22 will be described, however, it is applicable to drum half 24. The drum halves 22, 24 are separable from one another. Drum half 22 has a journal shaft portion 130 projecting from the wall 110 and a journal shaft portion 132 projecting from the wall 112. In a preferred embodiment, the journal shaft portions 130, 132 are molded as an integral part of the drum half 22. Journal shaft portions 130, 132 align and mate with one another to form a complete generally circular journal shaft that will fit within paired and aligned respective recess 50 and recess 84 (FIG. 1) when the drum halves 22, 24 are assembled to form the drum 14. As shown, each of the journal shaft portions 130, 132 have a radial flange 136, 138, respectively, to help position the journal shaft portions 130, 132 within a respective recess 50 to limit lateral movement while the drum 14 is mounted in the base 16. To help align the drum halves 22, 24 with one another for sifting operation, and to prevent relative movement during sifting operation, the journal shaft portion 130 has a notch 150, while the journal shaft portion 132 has an outwardly projecting tab 152 that can be received within a respective notch 150 to interlock the two drum halves 22, 24 together without the need for snap fasteners or mechanical clasps.

Figure 2:
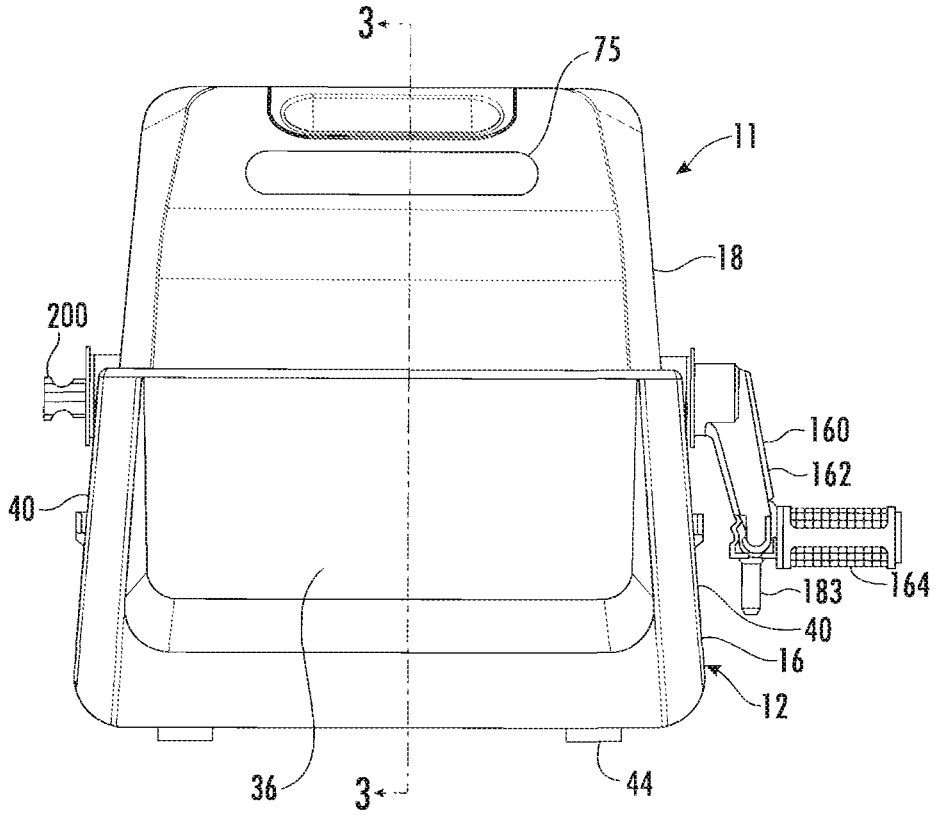
FIG. 2 is a front elevation view of the media sifter.
Figure 4:
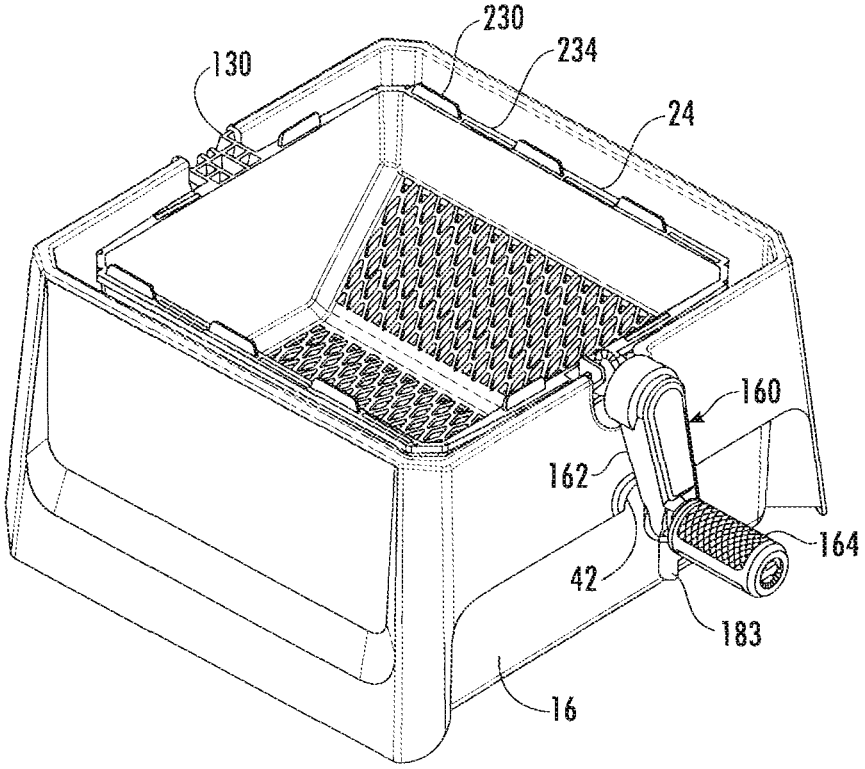
FIG. 4 is a perspective view of the base portion and a bottom drum portion of the media sifter with the handle in an unlocked and cranking orientation.
Figure 5:
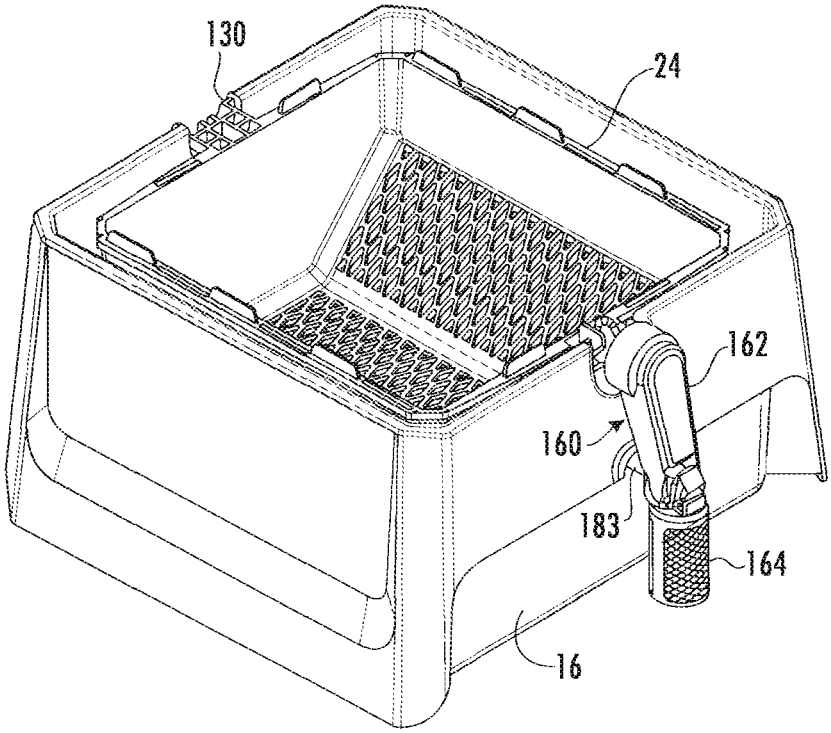
FIG. 5 is a perspective view of the base portion and a bottom drum portion of the media sifter with the handle in a locked and non-cranking orientation.

The media sifter 11 is provided with means to effect rotation of the drum 14 on its joined journal shafts portions 130, 132 when the drum 14 is assembled for use. In the illustrated structure, a crank, designated generally 160, is mounted to the journal shaft portion 132 and is positioned outside the base 16 in use. The crank 160 can be seen assembled in FIG. 2, and disassembled in FIG. 1. The crank 160 comprises a crank arm 162 and a crank handle 164. The crank handle 164 is pivotally mounted to the crank arm 162. As shown, the crank arm 162 has two components, or halves, that are joined together by mechanical fasteners 170. As shown in FIG. 6, the crank handle 164 includes a grip 176 that is mounted on a handle 178 as with snap locks 180 extending through an opening 182 which allows the grip 176 to rotate relative to the handle 178. The crank 160 is provided with a lock device to selectively lock the drum 14 against rotation to facilitate its filling. As shown, the lock device includes a lock pin 183 mounted to the handle 178. As shown, the lock pin 183 extends generally at a right angle to the handle 178. The handle 178 is pivotally mounted on the crank arm 162 as by the projections 186 extending into a bore 188. A pair of grooves 190, 192 are provided on the handle 178 to assist in holding the handle 178 selectively in one of two positions, folded down for locking the drum in place by having the lock pin 183 selectively received in the notch 42 and folded up to effect cranking. These two positions can be best seen in FIG. 4 and FIG. 5, with FIG. 4 showing the handle 178 in a cranking position and FIG. 5 showing the handle 178 in a drum locking position. A retainer device, such as a spring lock 194, can be formed as part of the handle 162 and be receivable within a respective groove 190 or 192 to releasbly retain the handle 178 in a selected position. The crank 160 is suitably mounted to one of the drum halves, for example drum half 22. The crank arm 162 is suitably secured to the journal shaft portion 132. Referring to FIG. 6, the shaft portion 132 is provided with a positive drive member 200. Preferably the drive member 200 is of a spline type and, as shown, is in the shape of a +. The drive member 200, as shown, includes four projecting teeth designated 202, 204, 206, 208. The teeth 202, 206 are received in grooves 212 in each of the arm halves of crank arm 162. This prevents relative rotation between the drive member 200 and the crank arm 162. To prevent longitudinal movement of the crank arm 162 off of the drive member 200, a notch 214 is provided in the tooth 208 that receives therein a projection 216 in a crank arm 162 half. The fasteners 170 secure the two components of the crank arm 162 (FIG. 1) to the drive member 200. In a preferred embodiment, the height of the teeth 204 and 208 can be different from each other, with the height of tooth 204 being the lesser. By adjusting the spacing of the projections 216 and 220 from the groove 212, the crank arm 162 can be mounted in only one orientation relative to the drive member 200. Through use of the above described drive member 200 and crank arm 162, a spline connection between the two is provided. This form of mounting allows positive indexing of the crank arm 162 and the handle 164 to the drum half 22, such that when the lock pin 183 is moved into the notch 42, it locks the drum half 22 into a generally upwardly opening rotational position (for example, +/−30° from horizontal). In operation, the cover 18 releasably retains the drum 14 as an assembly in the base 16 without the need for mechanical fastening devices.

To further assist in joining the drum halves 22, 24 together for use, each of the drum halves is provided with at least one and preferably a plurality of tabs 230 projecting from an abutting free edge face 232 of each drum half. Each tab 230 has a corresponding slot 234 in an opposite abutting free edge face 232 of the opposite drum half to fit therewithin. The positions of the tabs 230 and slots 234 alternate, as best seen in FIG. 6, with a tab 230 being adjacent an end wail 112, while a slot 234 is adjacent to an end wall 110.

Position and orientation terms used herein, like top, bottom and side, are used in the sense that the sifter 11 is in a normal operating position resting on a horizontal surface.

In use, a user will remove the cover 18 if installed. The drum 14 is rotated, if needed, until the bottom half 22 is in a lowermost position. The top drum half 24, if installed, is removed, exposing the open top of the bottom drum half 22. The drum half 22 is locked against rotation with lock pin 183. Media and casings are then poured into the drum half 22, after which the drum half 24 is mounted to the drum half 22. The cover 18 is then installed, preventing separation of the drum halves 22, 24 during rotation of the drum 14. The drum 14 is unlocked, and the drum 14 rotated using the crank 160. When the media is separated, as can be observed through the cover 18, the drum half 22 can again be locked in its lowermost position, the cover removed, the top drum half 24 is separated from the bottom drum half 22, and the crank 160 unlocked, allowing removal of the bottom drum half 22 and the contained casings.

It is to be understood that while certain forms of the invention are illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A media sifter operable to separate media from casings, said media sifter including:

a housing including a base and a cover, said base having an open top chamber and a pair of opposite first and second sidewalls, each with an upwardly opening first recess, said cover having a pair of opposite third and fourth sidewalls and being removably mounted on said base;

a drum having first and second selectively separable drum halves rotatably mounted in said chamber, said first and second drum halves each having a shaft portion projecting therefrom, said shaft portions being rotatably received in a respective said first recess, said third and fourth sidewalls each having a portion positioned over a respective said first recess and respective said shaft portion, selectively retaining the drum mounted in said chamber, at least one of said first and second drum halves having a perforated portion;

a crank secured to said first drum half and operable to effect selective rotation of said drum in said base, said crank including a crank arm and a handle mounted to said crank arm, said crank handle being positioned outside of said base; and a lock device associated with said crank and operable to selectively lock the crank and the first drum half in a rotational position where said first drum half opens generally upwardly.

2. The media sifter of claim 1 wherein the first and second drum halves each having a shaft portion extending from opposite sides thereof with each said shaft portion of one said drum half cooperating with a respective shaft portion of the other said drum half to form a round shaft extending from each of opposite ends of said drum.

3. The media sifter of claim 2 wherein said first and second drum halves being substantially identical in construction.

4. The media sifter of claim 3 wherein the first drum half having at least one tab on an edge face and at least one slot on an opposite edge face, said second drum half having at least one tab on an edge face and at least one slot on an opposite edge face, said tab of the first drum half being received in a respective said slot of said second drum and said tab of the second drum half being received in a respective said slot of the first drum half, assisting in limiting movement between said first and second drum halves when they are assembled, forming the drum while allowing selective separation.

5. The media sifter of claim 4 wherein said cover releasably securing said first and second drum halves in a drum forming assembly when said cover is mounted on said base.

6. The media sifter of claim 5 wherein said first drum half having a first said shaft portion extending from each of opposite first end walls of said first drum half, and said second drum half having a second said shaft portion extending from each of opposite second end walls of said second drum half, each said first shaft portion mating with a respective said second shaft portion, forming a shaft each receivable in a respective said first recess.

7. The media sifter of claim 6 wherein the cover including a downwardly opening second recess in each of said third and fourth sidewalls, each positioned to align with a respective said first recess to receive a respective said shaft therein.

8. The media sifter of claim 1 wherein said crank arm and said handle being positioned outside of said base, said handle being pivotally mounted to said crank arm, said lock device including a lock pin secured to said handle and being movable therewith, said base including a notch adjacent a sidewall thereof and being positioned and oriented to selectively receive said lock pin therein upon pivoting movement of said handle relative to said crank arm to selectively prevent rotation of said first drum half.

9. The media sifter of claim 8 wherein said crank being removably mounted to said first drum half.

10. The media sifter of claim 1 wherein said base and said first and second drum halves being made of molded polymeric material.

11. The media sifter of claim 10 wherein said cover having at least a portion thereof transparent.

* * * * *